United States Patent [19]

Cruse

[11] 4,262,228

[45] Apr. 14, 1981

[54] ELECTRIC LAMP WITH U-SHAPED SUPPORT WIRES

[75] Inventor: Oliver B. Cruse, Florissant, Mo.

[73] Assignee: Wagner Electric Corporation, Parsippany, N.J.

[21] Appl. No.: 58,532

[22] Filed: Jul. 18, 1979

[51] Int. Cl.[3] ..... H01K 1/28; H01K 1/44

[52] U.S. Cl. ..... 313/25; 313/51; 313/113; 313/318; 339/144 T

[58] Field of Search ..... 313/113, 318, 25, 51, 313/222; 339/144, 144 T, 145 T, 145 R; 362/226, 310

[56] References Cited

U.S. PATENT DOCUMENTS

| | | | |
|---|---|---|---|
| 2,851,623 | 9/1958 | Berger | 313/51 |
| 3,553,520 | 1/1971 | Hicks . | |
| 3,904,904 | 9/1975 | Melnecke et al. . | |
| 3,917,939 | 11/1975 | Schmidt et al. . | |
| 4,166,232 | 8/1979 | Kimball et al. | 313/318 X |
| 4,171,497 | 10/1979 | Shinoda | 313/318 X |

*Primary Examiner*—Palmer C. Demeo

*Attorney, Agent, or Firm*—D. F. Marquette

[57] ABSTRACT

An electric lamp including a reflector and a lens secured together to define an enclosure therebetween. A bulb is supported in the enclosure by support wires. Each support wire has a substantially U-shaped portion, and the base portion of the bulb is engaged in the substantially U-shaped portions of the support wires.

14 Claims, 12 Drawing Figures

ELECTRIC LAMP WITH U-SHAPED SUPPORT WIRES

BACKGROUND AND SUMMARY OF THE INVENTION

This invention relates generally to electric lamps and more particularly to electric head lamps for motor vehicles.

In prior vehicle halogen lamps, a halogen bulb has been supported in the enclosure of the lamp by apparatus including one or more support wires secured to mounting means which is attached to the base portion of the halogen bulb. This type of apparatus is used in the lamp disclosed in U.S. Pat. No. 3,904,904 where the mounting means attached to the halogen bulb base portion consists of a sleeve-shaped cap made of metal sheet material.

The electric lamp of the present invention includes a reflector, a lens secured to the reflector to define an enclosure therebetween, and a bulb disposed in the enclosure. The bulb has an envelope portion containing a filament and a base portion. A pair of support wires support the bulb in the enclosure. Each support wire has a substantially U-shaped portion, and the base portion of the bulb is engaged in the substantially U-shaped portions of the support wires. Each support wire has a leg connected to the reflector. The bulb has a pair of lead wires connected to the filament and to the support wires. In one embodiment of the invention, the bulb base portion has grooves formed therein, and the legs of the U-shaped portions of the support wires are disposed to the grooves. In another embodiment, the bulb base portion has flat portions engaged between the legs of the U-shaped portions of the support wires, and each support wire has another leg in abutment with the bulb base portion.

DESCRIPTION OF THE PREFERRED EMBODIMENTS

Figure 1:
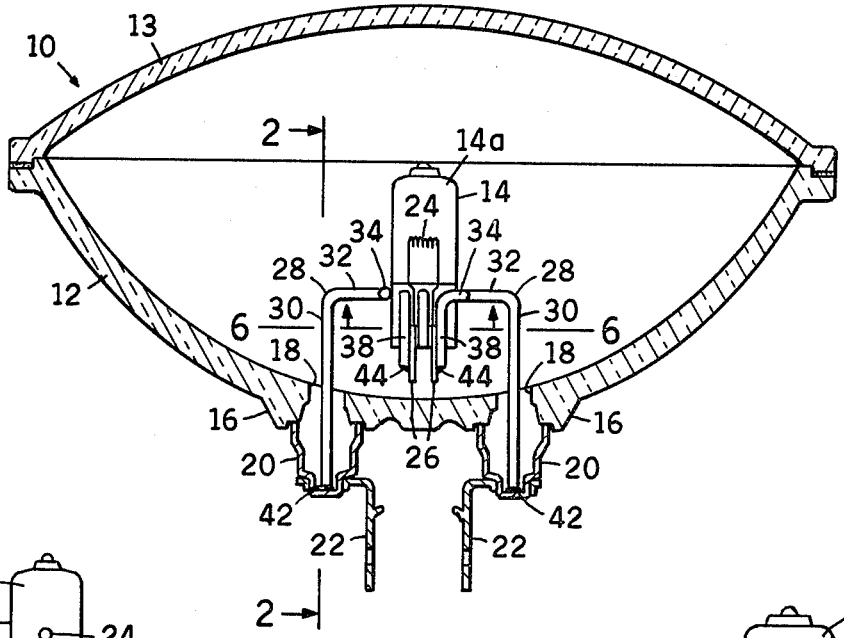
FIG. 1 is a sectional view of a vehicle head lamp incorporating one embodiment of the present invention.
Figure 2:
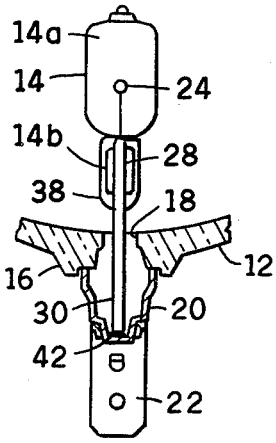
FIG. 2 is a sectional view taken along lines 2—2 in FIG. 1.
Figure 3:
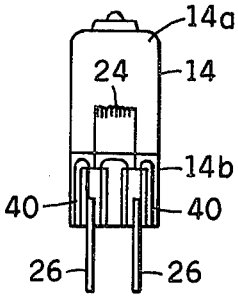
FIG. 3 is a view of one of the parts of the vehicle head lamp of FIG. 1.

Referring to FIG. 1, a vehicle electric head lamp 10 incorporating one embodiment of the present invention includes a reflector 12, a lens 13, and a bulb 14 such as a halogen bulb. The reflector 12 and the lens 13, preferably formed of glass or plastic, are secured together at their peripheries by conventional means such as fusion sealing, screws or adhesive, thereby forming an enclosure. The reflector 12 has a pair of bosses 16 integrally formed on the rear surface thereof and a pair of openings 18 extending therethrough. Ferrules 20 are secured to the bosses 16 so as to cover the openings 18. Terminals 22 are attached to the ferrules 20 for connecting the head lamp 10 to the electrical power supply of a vehicle. The bulb 14 includes a filament 24 supported in the envelope portion 14*a* thereof and a pair of lead wires 26 connected to the filament 24 and extending outwardly from the base portion 14*b* thereof.

Figure 6:
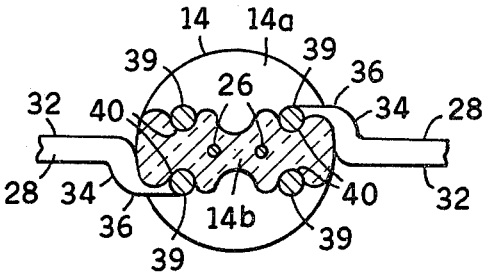
FIG. 6 is an enlarged sectional view taken along lines 6—6 in FIG. 1.
Figure 4:
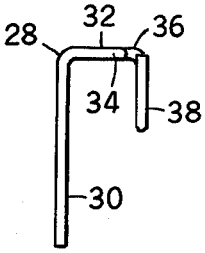
FIG. 4 is a view of another of the parts of the vehicle head lamp of FIG. 1.
Figure 5:
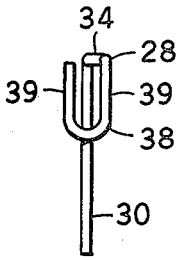
FIG. 5 is a side view of the part illustrated in FIG. 4.

Support wires 28 are provided for supporting the bulb 14 in the enclosure of the head lamp 10. In this particular embodiment, the support wires 28 are identical and as best shown in FIGS. 4, 5 and 6 each includes a first leg 30, a second leg 32 connected to the first leg 30 at a right angle, a third leg 34 connected to the second leg 32 at an obtuse angle of about 135°, a fourth leg 36 connected to the third leg 34 at an acute angle of about 45°, and a U-shaped portion 38 connected to the fourth leg 36. As seen in FIGS. 1 and 6, the base portion 14*b* of the bulb 14 is engaged in the U-shaped portions 38 of the support wires 28 with the legs 39 of the U-shaped portions 38 disposed in grooves 40 formed, such as by molding, in the bulb base portion 14*b*.

The first legs 30 of the support wires 28 extend through the openings 18 in the reflector 12 and are secured at 42 to the ferrules 20 by conventional means such as welding or brazing. The lead wires 26 of the bulb 14 are secured at 44 to the U-shaped portions 38 of the support wires 28 by conventional means such as welding or brazing. The bulb 14 is thus ridigly supported in the enclosure of the head lamp 10.

Figure 7:
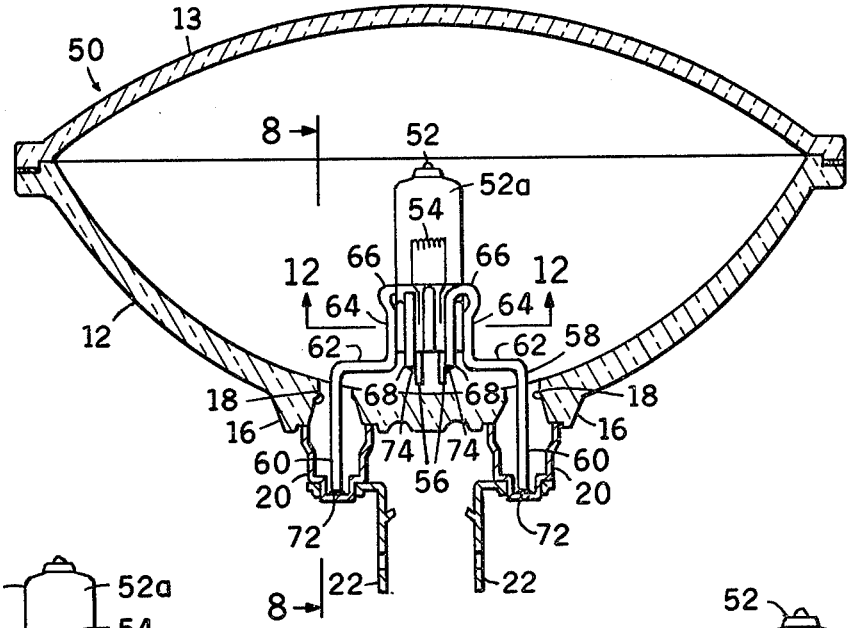
FIG. 7 is a sectional view of a vehicle head lamp incorporating another embodiment of the present invention.
Figure 8:
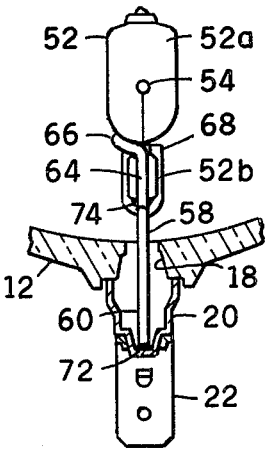
FIG. 8 is a sectional view taken along lines 8—8 in FIG. 7.
Figure 9:
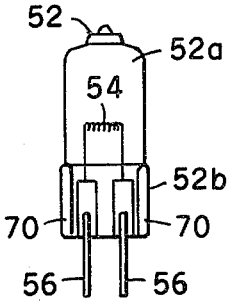
FIG. 9 is a view of one of the parts of the vehicle head lamp of FIG. 7.

Referring now to FIG. 7, a vehicle electric head lamp 50 incorporating another embodiment of the present invention includes the same type of reflector 12, lens 13, ferrules 20, and terminals 22 as the head lamp 10. The head lamp 50 includes a bulb 52 such as a halogen bulb which has a filament 54 supported in the envelope portion 52*a* thereof and a pair of lead wires 56 connected to the filament 24 and extending through the base portion 52*b* thereof.

Figure 12:
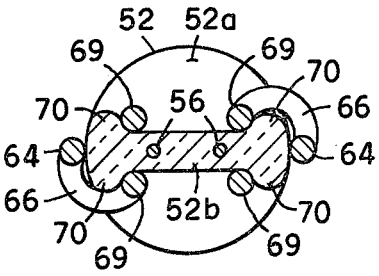
FIG. 12 is an enlarged sectional view taken along lines 12—12 in FIG. 7.
Figure 10:
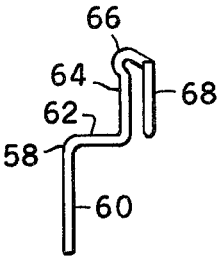
FIG. 10 is a view of another of the parts of the vehicle head lamp of FIG. 7.
Figure 11:
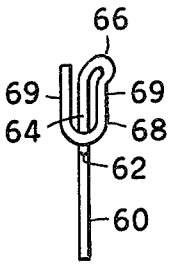
FIG. 11 is a side view of the part illustrated in FIG. 10.

Support wires 58 are provided for supporting the bulb 52 in the enclosure of the head lamp 50. In this particular embodiment, the support wires 58 are identical and as best shown in FIGS. 10 and 11 each includes a first leg 60, a second leg 62 connected to the first leg 60 at a right angle, a third leg 64 connected to the second leg 62 at a right angle, a curved portion 66 connected to the third leg 64, and a U-shaped portion 68 connected to the curved portion 66. As seen in FIGS. 7 and 12, the base portion 52*b* of the bulb 52 is engaged in the U-shaped portions 68 of the support wires 58 with flat portions of the bulb base portion 52*b* engaged between the legs 69 of the U-shaped portions 68, and with the third legs 64 of the support wires 58 in abutment with the edges of the bulb base portion 52*b*. Shoulders 70 formed, such as by molding, on the bulb base portion 52*b* assure proper engagement between the bulb base porton 52*b* and the U-shaped portions 68 of the support wires 58.

The first legs 60 of the support wires 58 extend through the openings 18 in the reflector 12 and are secured at 72 to the ferrules 20 by conventional means such as welding or brazing. The lead wires 56 of the bulb 52 are secured at 74 to the U-shaped portions 68 of the support wires 58 by conventional means such as welding or brazing. The bulb 52 is thus rigidly supported in the enclosure of the head lamp 50.

It is apparent that the bulb 14 could be used with the support wires 58 and the bulb 52 could be used with the support wires 28 in further embodiments of the invention.

The present invention is not limited to lamps having single filament bulbs such as bulbs 14 and 52. Accordingly, dual filament bulbs which have two filaments and three lead wires could be used. Two support wires would still be used to support a dual filament bulb in the lamp enclosure in the same manner previously described. Two of the lead wires from the dual filament bulb would be secured to the two support wires which are connected to two terminals on the reflector as described previously, and the third lead wire would be connected to a third terminal mounted on the reflector.

The present invention is not limited for use in round lamps such as head lamps 10 and 50 and, accordingly, may be used in rectangular lamps. The legs of the support wires may be modified as needed to properly support a bulb in the enclosure of a rectangular lamp.

The present invention is not limited to using the type of support wires 28 and 58 and, accordingly, other types of support wires which have a U-shaped portion in which the base portion of the bulb may be engaged could be used.

It will be understood that the claims are intended to cover all modifications and variations of the preferred embodiments of the invention, herein chosen for the purpose of illustration, without departing from the spirit and scope of the invention.

I claim:

1. An electric lamp, comprising:
(a) a reflector;
(b) a lens secured to said reflector to define an enclosure therebetween;
(c) a bulb disposed in said enclosure, said bulb having an envelope portion containing a filament and a base portion;
(d) a pair of support wires supporting said bulb in said enclosure, each of said support wires having a substantially U-shaped portion; and
(e) said base portion of said bulb being engaged in the substantially U-shaped portions of said support wires.

2. The electric lamp defined in claim 1, wherein:
(a) each of said support wires has a leg connected to said reflector; and
(b) said bulb has a pair of lead wires connected to said filament and to said support wires.

3. The electric lamp defined in claim 2, wherein:
(a) said base portion of said bulb has grooves formed therein; and
(b) the legs of the U-shaped portions of said support wires are disposed in said grooves wereby said bulb is rigidly supported in said enclosure.

4. The electric lamp defined in claim 2, wherein:
(a) said base portion of said bulb has flat portions engaged between the legs of the U-shaped portions of said support wires; and
(b) each of said support wires has another leg in abutment with said base portion of said bulb whereby said bulb is rigidly supported in said enclosure.

5. The electric lamp defined in claim 1, wherein each of said support wires includes:
(a) a first leg connected to said reflector;
(b) a second leg connected to said first leg at a right angle;
(c) a third leg connected to said second leg at an obtuse angle;
(d) a fourth leg connected to said third leg at an acute angle; and
(e) said U-shaped portion connected to said fourth leg.

6. The electric lamp defined in claim 1, wherein each of said support wires includes:
(a) a first leg connected to aid reflector;
(b) a second leg connected to said first leg at a right angle;
(c) a third leg connected to said second leg at a right angle;
(d) a curved portion connected to said third leg; and
(e) said U-shaped portion connected to said curved portion.

7. In a vehicle head lamp of the type including a reflector, a lens secured to said reflector to define an enclosure therebetween, a bulb disposed in said enclosure, said bulb having an envelope portion containing a filament and a base portion, said a pair of support wires supporting said bulb in said enclosure, the improvement comprising:
(a) each of said support wires having a substantially U-shaped portion; and
(b) said base portion of said bulb being engaged in the substantially U-shaped portions of said support wires.

8. The improvement defined in claim 7, wherein:
(a) each of said support wires has a leg connected to said reflector; and
(b) said bulb has a pair of lead wires connected to said filament and to said support wires.

9. The improvement defined in claim 8, wherein;
(a) said base portion of said bulb has grooves formed therein; and
(b) the legs of the U-shaped portions of said support wires are disposed in said grooves whereby said bulb is rigidly supported in said enclosure.

10. The improvement defined in claim 8, wherein:
(a) said base portion of said bulb has flat portions engaged between the legs of the U-shaped portions of said support wires; and
(b) each of said support wires has another leg in abutment with said base portion of said bulb whereby said bulb is rigidly supported in said enclosure.

11. In an electric lamp of the type including a bulb having an envelope containing a filament and a generally flat base, and a pair of support wires for supporting said bulb, the improvement comprising each of said support wires having a substantially U-shaped portion, and said flat base of said bulb being engaged between the legs of the substantially U-shaped portions of said support wires so that said U-shaped portions straddle said flat base.

12. The improvement defined in claim 11, wherein said bulb has a longitudinal axis, and the legs of the U-shaped portions of said support wires extend substantially parallel to the longitudinal axis of said bulb.

13. The improement defined in claim 11, wherein said bulb has lead wires connected to said filament and to the U-shaped portions of said support wires.

14. A vehicle headlamp comprising:

(a) a reflector;
(b) a lens secured to said reflector to define an enclosure therebetween;
(c) a bulb disposed in said enclosure, said bulb having an envelope containing a filament and a generally flat base;
(d) a pair of support wires supporting said bulb in said enclosure, each of said support wires having a substantially U-shaped portion; and
(e) said flat base of said bulb being engaged between the legs of the U-shaped portions of said support wires so that said U-shaped portions straddle said flat base.

* * * * *